US007344050B2

(12) United States Patent
Robrechts

(10) Patent No.: US 7,344,050 B2
(45) Date of Patent: Mar. 18, 2008

(54) TRANSPORT MEANS FOR A PRODUCT DISTRIBUTION INSTALLATION

(75) Inventor: Jozef Robrechts, Rijkevorsel (BE)

(73) Assignee: VTL Group Limited, Auckland (NZ)

( * ) Notice: Subject to any disclaimer, the term of this patent is extended or adjusted under 35 U.S.C. 154(b) by 360 days.

(21) Appl. No.: 10/485,459

(22) PCT Filed: Jul. 31, 2002

(86) PCT No.: PCT/BE02/00131

§ 371 (c)(1),
(2), (4) Date: Feb. 2, 2004

(87) PCT Pub. No.: WO03/012752

PCT Pub. Date: Feb. 13, 2003

(65) Prior Publication Data

US 2004/0213649 A1 Oct. 28, 2004

(30) Foreign Application Priority Data

Jul. 31, 2001 (BE) ..... 2001/0518

(51) Int. Cl.
*G07F 11/00* (2006.01)

(52) U.S. Cl. ..... 221/120; 221/119; 221/121; 221/112; 221/113; 221/133

(58) Field of Classification Search ..... 221/119, 221/120, 92, 76–81, 84–86, 166, 192, 224, 221/260; 700/242–243
See application file for complete search history.

(56) References Cited

U.S. PATENT DOCUMENTS

| | | | | |
|---|---|---|---|---|
| 3,265,244 | A * | 8/1966 | Brown | 221/103 |
| 3,750,804 | A * | 8/1973 | Lemelson | 414/276 |
| 6,253,954 | B1 * | 7/2001 | Yasaka | 221/93 |
| 6,415,950 | B1 * | 7/2002 | Robrechts | 221/85 |
| 6,494,342 | B1 * | 12/2002 | Wittern et al. | 221/192 |

FOREIGN PATENT DOCUMENTS

| | | |
|---|---|---|
| EP | 0779605 | 6/1997 |
| FR | 996663 | 12/1951 |
| JP | 02183891 | 7/1990 |
| WO | WO-9858804 | 12/1998 |
| WO | WO 9858804 A2 * | 12/1998 |

* cited by examiner

*Primary Examiner*—Gene O. Crawford
*Assistant Examiner*—Michael K Collins
(74) *Attorney, Agent, or Firm*—Browdy and Neimark, PLLC

(57) ABSTRACT

A distribution installation for products (11) arranged in compartments (10, 10') with transport means (13) for transferring the products (11) from said compartments (10, 10') to a dispensing hatch (5). Said transport means (13) comprise a deformable reception means (29) which are connected to at least a first and a second attachment element (30, 31). The attachment elements (30, 31) can move relative to each so that the reception means (29) have at least a reception position in which said products (11) are transferred from said compartments (10, 10') to the reception means (29), and a delivery position in which products (11) are transferred from the receiving means (29) to said dispensing hatch (5).

12 Claims, 3 Drawing Sheets

TRANSPORT MEANS FOR A PRODUCT DISTRIBUTION INSTALLATION

The invention concerns a distribution device for products arranged in compartments, with a transport equipment to convey these products from said compartments to a delivery counter, whereby said transport equipment comprises a deformable receiving instrument which is connected to at least a first and a second fastening element.

The transport equipment used for such a distribution device according to the present state of the art, as is described for example in WO 9858804, has a relatively complex construction and requires the use of several electric motors. Moreover, the conveyance of products from said compartments to the delivery counter is relatively time-consuming.

The invention aims to remedy these disadvantages by providing a device with a relatively simple construction which makes it possible to convey products from said compartments to the delivery counter in a very short time.

To this aim, said fastening elements can be relatively moved in relation to one another, such that the receiving instrument can at least assume a receiving position, whereby said products can be moved from said compartments to the receiving instrument, and a delivery position, whereby the products are moved from the receiving instrument to said delivery counter.

Practically, the distance between said fastening elements is almost of the same order of magnitude as the length of said receiving instrument in said delivery position, such that the latter is practically extended, whereby the receiving instrument is inclined in such a manner that products resting upon it are moved to said delivery counter.

In an advantageous manner, the receiving instrument in said receiving position has a convex shape in which said products can be collected.

According to a preferred embodiment of the distribution device according to the invention, said second fastening element is fixed to a movable arm co-operating with at least one driving element for the conveyance of said products to the receiving instrument, whereby this driving element can work in conjunction with at least one of said compartments in said receiving position.

In particular, said driving element is formed of a first gear wheel co-operating with a second gear which is provided to said compartment.

According to a particular embodiment of the device according to the invention, said compartment has at least one pusher attachment for guiding said products to the receiving instrument, whereby this pusher attachment is connected to a drive belt extending almost over the entire length of said compartment and co-operating with said driving element when the receiving instrument is in said receiving position.

According to an advantageous embodiment of the device according to the invention, means are provided to move said pusher attachment over a smaller distance in the opposite sense after certain products from the corresponding compartment have been put on the receiving instrument, such that this pusher attachment exerts almost no pressure on the other products situated in said compartment.

Other particularities and advantages of the invention will become clear from the following description of a few special embodiments of the invention; this description is given as an example only and does not restrict the scope of the claimed protection in any way; the reference figures used hereafter refer to the accompanying drawings.

In the different drawings, the same reference figures refer to identical or analogous elements.

Figure 1:
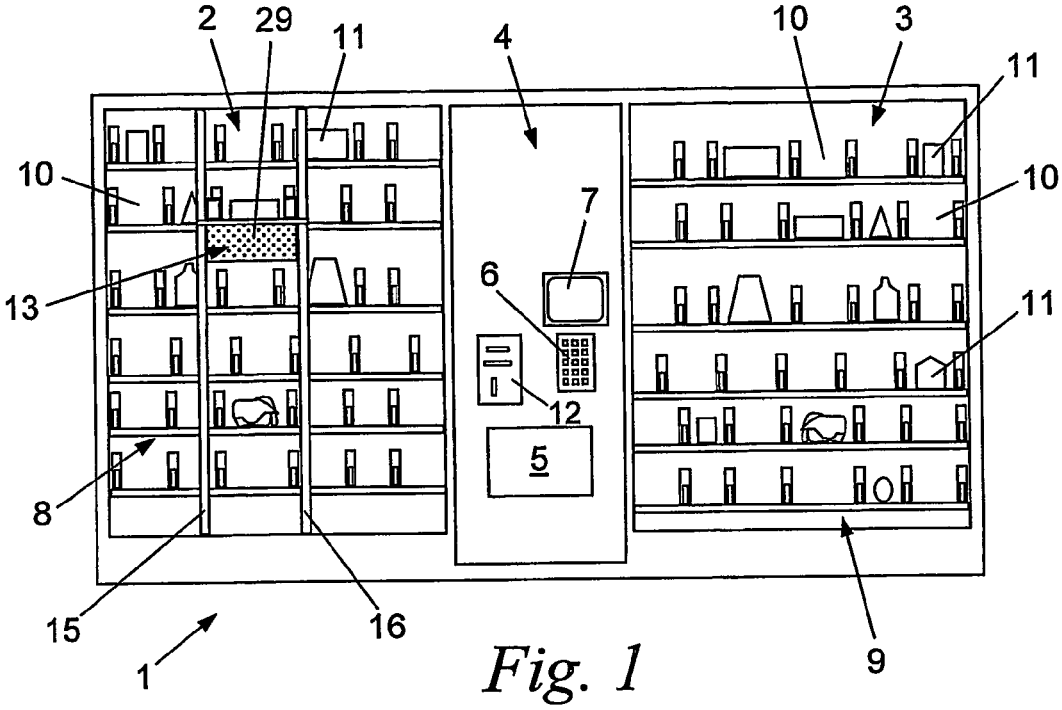
FIG. 1 is a schematic front view of a distribution device according to the invention.
Figure 2:
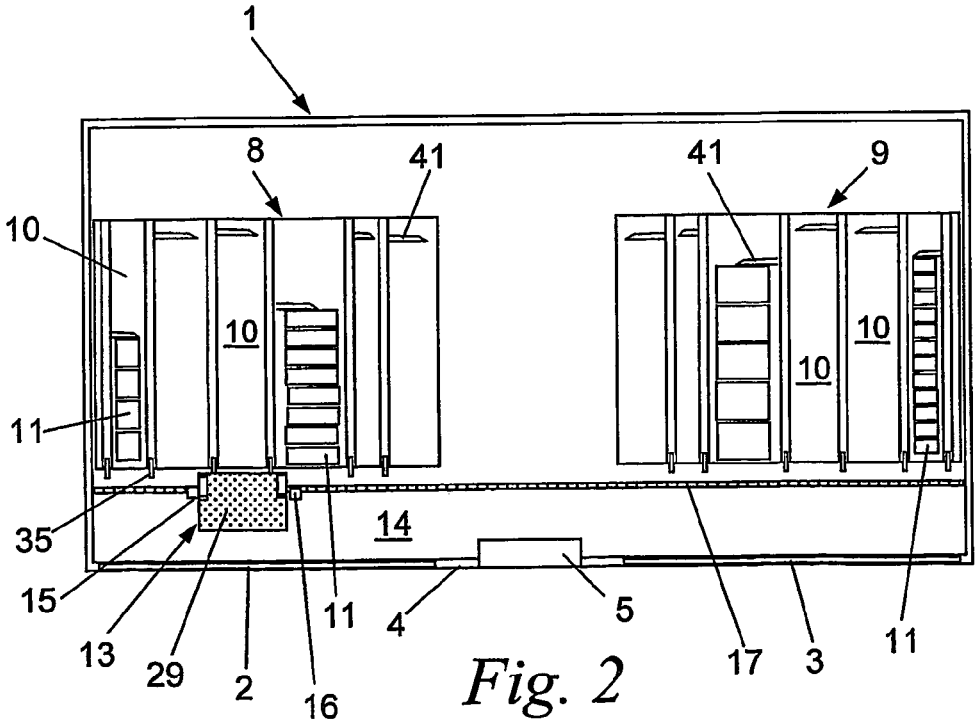
FIG. 2 is a schematic top view of a distribution device according to the invention.

FIGS. 1 and 2 schematically represent a distribution device according to the invention. This distribution device 1 has a rectangular housing whereby two display windows 2 and 3 are provided on the front side, separated by a control panel 4 with a delivery counter 5, a keyboard 6 and a picture screen 7. Further, a rack 8 and 9 is placed behind each display window 2 and 3, with compartments 10 extending across the display window 2 or 3. In each compartment 10 rests a row of products of the same type, whereby only the first product is visible through the display window 2 or 3 situated opposite to the respective compartment 10.

A user of the distribution device wishing to obtain a product 10 indicates his choice by means of said keyboard 6. This inputted choice is represented on the picture screen 7, together with the sales price of the respective product 10. When the user next puts in money via a payment unit 12, accepting for example coins, bank notes or credit cards, the product concerned is conveyed from the corresponding compartment 10 to the delivery counter 5, and the user can take the product 11 from the latter.

To thus convey a product 11 from a compartment 10 to the delivery counter 5, a transport equipment 13 is provided which can be moved in the free space 14 between said racks 8 and 9 and the display windows 2 and 3. To this end, this conveyor unit 13, in the embodiment of the distribution device as represented in FIGS. 1 and 2, is mounted on two vertical guide rails 15 and 16, such that the conveyor unit can be vertically moved over the latter. Further, the guide rails 15 and 16 can be horizontally moved in a plane which is almost parallel to said display windows 2 and 3 over a horizontal guide rail 17 provided on the bottom of the distribution device. A second horizontal guide rail is preferably provided on the top side of said vertical guide rails 15 and 16, which is almost parallel to said guide rail 17 provided on the bottom of the distribution device 1.

Thus, the transport equipment 13 can be moved between the compartment 10 in which the required product 11 is situated and the delivery counter 5. To this end, the transport equipment 13 is moved over said vertical guide rails 15 and 16 on the one hand, while the latter are moved over the horizontal guide rail 17 on the other hand. Consequently, the transport equipment 1 is guided directly from a compartment 10 to the delivery counter 5, for example diagonally.

Figure 3:
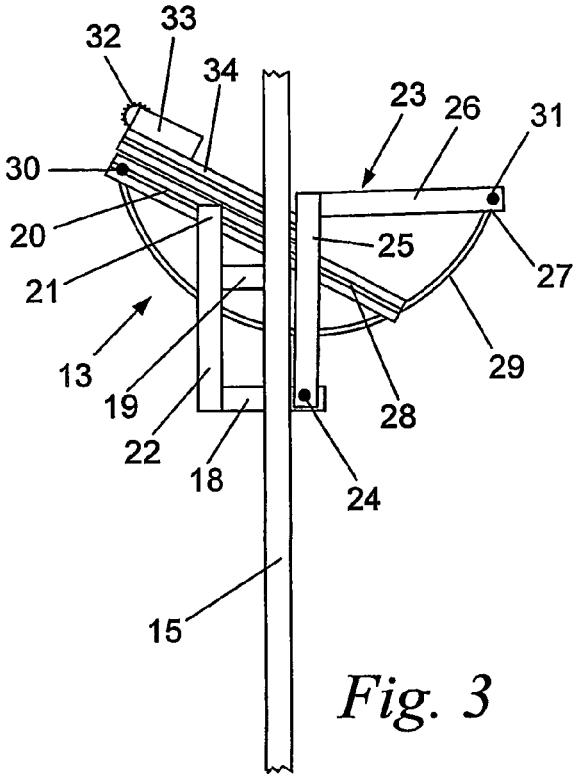
FIG. 3 is a schematic side view of the transport equipment according to the invention, in what is called a receiving position.
Figure 4:
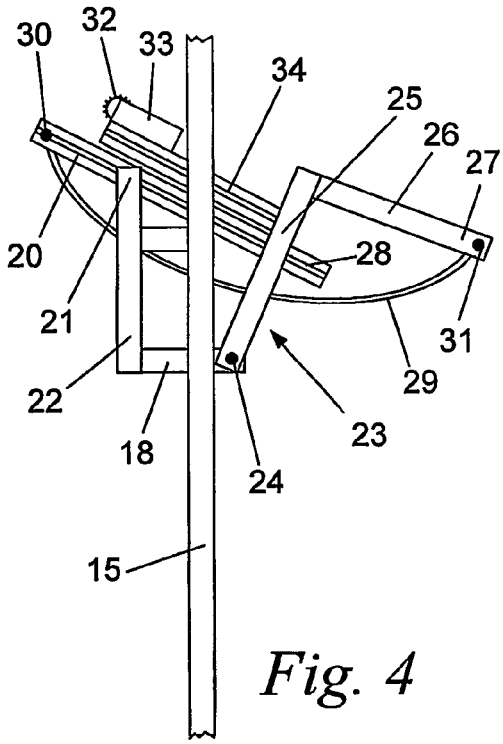
FIG. 4 is a schematic side view of the transport equipment from FIG. 3 in what is called a conveying position.
Figure 5:
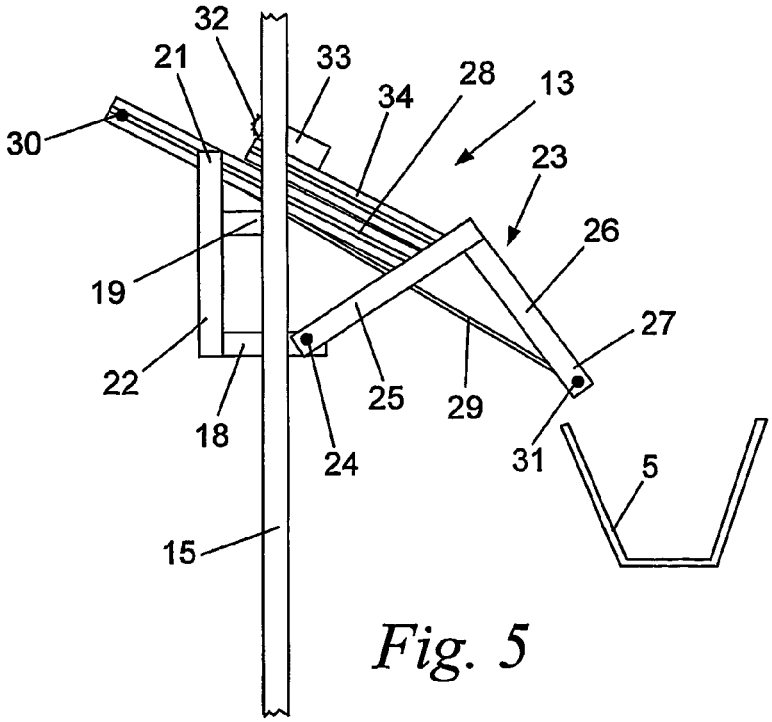
FIG. 5 is a schematic side view of the transport equipment from FIGS. 3 and 4 in what is called a delivery position.

FIGS. 3 to 5 schematically represent a side view of the transport equipment 13, together with a vertical guide rail 15. The transport equipment 13 contains two horizontal struts 18 and 19 fixed on the guide rail 15 with means which are known as such, such that the transport equipment 13 can be moved according to this guide rail 15.

Further, the transport equipment 13 comprises a guide strut 20 extending in a plane which is almost athwart to said display windows 2 and 3, and which is parallel to the vertical guide rails 15 and 16. This guide strut 20 is fixed tightly to the far end 21 of a rod 22 connecting said horizontal struts 18 and 19. The guide strut 20 is inclined, whereby its topmost far end extends on the side of said compartments, while its lower far end is situated on the side of the display windows 2 and 3 and the delivery counter 5 of the distribution device. The struts 18 and 19, the guide strut 20 and the rod 22 form a rigid whole.

The lower strut 18 extends on either side of said guide rail 15. On the side opposite to said rod 22, a movable arm 23 is mounted to this strut 18 by means of a rotational shaft 24.

This movable arm 23 is L-shaped and thus has two rods 25 and 26 which are connected to one another with their far ends and are perpendicular in relation to one another. A first far end of the arm 23 is fixed to said strut 18 via the rotational shaft 24, whereas the second far end 27 of this arm 23 is free.

The arm 23 is preferably connected to the guide strut 20 by means of a sliding connection. Such a sliding connection contains a pin which works in conjunction with a longitudinal recess 28, extending in the guide strut 20 in its longitudinal direction on the one hand, and which works in conjunction with a corresponding recess provided in the rod 25 of the arm 23 on the other hand. Thus, the arm 23 can rotate around the rotational shaft 24, and is hereby guided along the guide strut 20.

The transport equipment 13 further comprises a receiving instrument 29 consisting of a supple, rectangular cloth which is mounted to the transport equipment 13 via two fastening elements 30 and 31.

A first fastening element 30 is provided on the far end of said guide strut 20 extending on the side of said compartments 10, whereas the second fastening element 31 is fixed to the far end 27 of the arm 23.

Thus, the fastening elements 30 and 31 can be relatively moved in relation to one another by subjecting the arm 23 to a rotation, such that the receiving instrument 29 can assume different positions.

On the top side of the guide strut 20 is provided a driving element which can be moved in the longitudinal direction of the guide strut 20. This driving element works in conjunction with said compartments 10 in order to convey products 11 to the receiving instrument 29. Thus, this driving element contains a gear wheel 32 which is driven by an electric motor 33, and it is mounted on a sliding rod 34 which is guided over the guide strut 20. The sliding rod 34 is connected to the arm 23 via one far end, and works in conjunction with the latter in such a manner that it can undergo a translation and a rotation in relation to the arm 23. Thus, the driving element is moved according to the longitudinal direction of the guide strut 20 when the arm 23 rotates.

FIG. 3 represents the receiving instrument 29 in what is called a receiving position. The arm 23 has been rotated here up to almost said vertical guide rail 15, such that the distance between said fastening elements 30 and 31 is minimal. In this manner, the receiving instrument 29 suspends freely between the fastening elements 30 and 31, and a convex space is formed in which a product 11 can rest.

In this receiving position, the sliding rod 34 is moved to almost the top end of said guide strut 20 together with the driving element. Thus, the gear wheel 32 extends in relation to the transport equipment 13, and it can mesh in a corresponding gear wheel 35 of a compartment 10 in order to convey a product 11 from this compartment 10 to the receiving instrument 29.

When a product 11 is situated on the receiving instrument 29, it is brought in what is called a conveying position as represented in FIG. 4. In this conveying position, the arm 23 has rotated over a small angle, away from the guide rail 15 around the rotational shaft 24, such that the distance between said fastening elements 30 and 31 increases somewhat. Said driving element, which is connected to the arm 23, is hereby removed from the compartment 10, such that the gear wheel 35 of the latter no longer meshes with the gear wheel 32 of the driving element.

Next, the transport equipment is moved up to the front of said delivery counter 5 by means of the above-mentioned guide rails 15, 16 and 17, and the receiving instrument 29, when the delivery counter 5 is reached, is placed in what is called a delivery position by rotating the arm 23 around the rotational shaft 24 until the distance between said fastening elements 30 and 31 is of almost the same order of magnitude as the length of the receiving instrument 29, as is represented in FIG. 5. In this delivery position, the receiving instrument 29 is almost entirely stretched and flat. The receiving instrument 29 is hereby inclined such that a product 11 resting upon it will slide over its surface into said delivery counter 5.

Said transport equipment is preferably made symmetrically, whereby a movable arm 23 and a guide strut 20 working in conjunction with it are provided on either side of said receiving instrument 29. Thus, each of said fastening elements 30 and 31 is formed of a rod connecting the guide struts 20 and the movable arms 23 respectively along either side of the receiving instrument 29.

Figure 6:
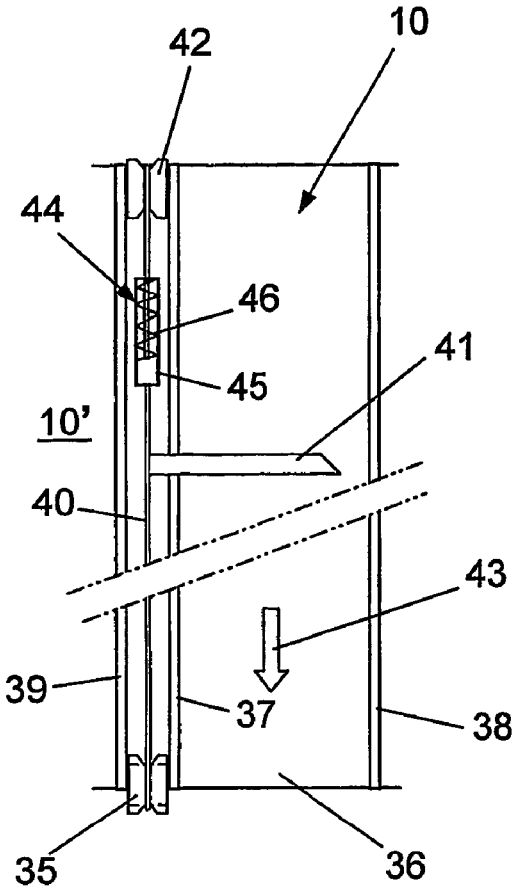
FIG. 6 is a schematic top view of a compartment of the distribution device according to the invention.
Figure 7:
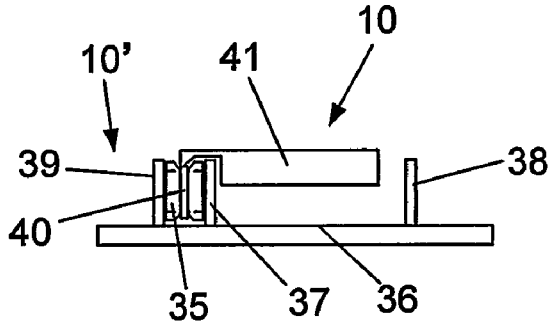
FIG. 7 is a schematic front view of the compartment from FIG. 6.

FIGS. 6 and 7 represent a compartment 10 of the rack 8 in detail. This compartment 10 has a flat bottom 36 upon which are provided parallel, vertical partitions 37 and 38. The products 11 to be divided are placed on the bottom 36 of the compartment 10 between these partitions 37 and 38. For clarity's sake, these products 11 are not represented in FIGS. 6 and 7.

On its front side, which is directed to the display window 2, the compartment 10 shows the above-mentioned gear wheel 35 working in conjunction with the gear wheel 32 of the transport equipment 13. This gear wheel 35 is situated between said partition 37 and a partition 39 of the compartment 10' lying next to it. The gear wheel 35 drives a drive belt formed of a cable 40, preferably made of steel, extending over almost the entire length of the compartment 10 and working in conjunction with a pusher attachment 41.

The cable 40 in particular forms a loop which is guided over said gear wheel 35 and over a wheel 42, situated on the opposite far end of the compartment 10. By driving the cable 40 by means of the gear wheel 35, said pusher attachment 41 is moved in the longitudinal direction of the compartment 10, as indicated by the arrow 43.

In order to convey a product 11 from the compartment 10 to said transport equipment 13, the latter is placed in said receiving position in front of the compartment 10, such that its gear wheel 32 meshes with the gear wheel 35 of the compartment 10 concerned.

The electric motor 33 is then driven such that the cable 40 working in conjunction with the gear wheel 35 is moved. The pusher attachment 41 is hereby moved in the direction of the arrow 43, and the product situated on the front side of the compartment 10 is pushed over the far edge of the bottom 36, so that it falls into said receiving instrument 29.

At the time when the product 11 thus falls over the edge of the bottom 36 into the receiving instrument 29, the product 11 is noticed by means of an optical eye which detects a light beam being interrupted. This light beam extends almost parallel to the edge of the bottom 36, such that a product 11 falling from the compartment 10 on the receiving instrument 29 will always intersect the light beam. For this light beam is preferably used infrared light.

When it is thus observed that a product 11 has fallen on the receiving instrument 29, said electric motor 33 is stopped, such that the pusher attachment 41 no longer moves.

According to a preferred embodiment of the distribution device according to the invention, the pusher attachment 41 is moved over a small distance in the opposite sense after said product has been pushed over the edge of the bottom 36. In particular, the pusher attachment 41 is moved in the opposite sense of the arrow 43, such that it no longer exerts any pressure force on the other products situated between the pusher attachment 41 and the front side of the compartment 10.

Further, the transport equipment 13 is put into said conveying position after the product 11 has fallen into the receiving instrument 29, in order to make sure that the gear wheel 32 is removed from the gear wheel 35 of the compartment 10. In this conveying position, the transport equipment 13 is then moved to said delivery counter 5, where the receiving instrument is placed in said delivery position and the product 11, as described above, is conveyed to the delivery counter 5.

Said cable 40, as already mentioned, is guided over the gear wheel 35 and the wheel 42 of the compartment 10. To this end, both the wheel 42 and the gear wheel 35, which also forms a wheel, have a notch extending over their circumferences. In order to avoid that these wheels 35 or 42 would be damaged, for example when the cable 40 gets stuck in the wheel 42 or when the movement of the pusher attachment 41 is hindered, for example because said products 11 are jammed in the compartment 10, the far ends of the cable 40 are connected to one another by means of a spring element 44.

This spring element 44 makes it possible for the far ends of the cable 40 to be relatively moved in relation to one another while the cable 40 is being driven by said electrical motor 33. Thus, the cable 40 is prevented from slipping in relation to the wheels 35 and 42 and from cutting itself into the latter.

Consequently, if a problem should arise regarding the movement of the cable 40, the power which has to be supplied by the electric motor 33 will increase. This is detected by the device as soon as the power required to move the cable 40 exceeds a certain value, so that the motor 33 is shut down and the drive of the cable 40 is consequently interrupted.

Said spring element 44 contains a cylindrical case 45, one end of which is connected to a first far end of said cable 40, while the second far end of the cable 40 is connected to a spring 46 extending in said case 45. The spring 46 is connected to the case 45 with the far end which is not connected to the cable 40, such that, when the cable 40 is jammed but is still being driven, this spring 46 is compressed, whereby the far ends of the cable 40 move away from one another.

Although, in the preceding description, the receiving instrument 29 is formed of a supple cloth, it may also contain a flat plate having at least one hinge line or folding line extending almost crosswise to the direction of movement of said second fastening element, or which is thus almost parallel to the edge of the bottom 36 of the compartments 10.

As a result, such a receiving instrument 29 will be folded somewhat in a V-shape in said receiving position, whereas in the delivery position, the receiving instrument is entirely flat and stretched.

The transport equipment according to the invention preferably has a driving element with an electric motor 33 and a gear wheel 32 on either side of the receiving instrument 29. Thus, the driving element on the left side of the receiving instrument 29 will be used to make products 11 fall from the rack 8 situated on the left of the control panel 4 into the receiving instrument 29, while the driving element on its right side will be used for products resting in the compartments 10 of the rack 9 situated on the right of the control panel 4.

Thus, the transport equipment 13 must move maximally over half of the width of the distribution device 1 to convey a product 11 from any compartment 10 whatsoever to the delivery counter 5 when the latter is situated almost in the middle of the front side of the distribution device. As a driving device is provided on either side of the receiving instrument, it is possible to reach the gear wheel 35 of the utmost left and right compartments 10 of the distribution device.

Further, the transport equipment 13 preferably has a vertical wall on either side of the receiving instrument 29 which prevents products 11 from falling wide of the side of the receiving instrument 29. For clarity's sake, these vertical walls are not represented in the figures.

Of course, the invention is not restricted to the embodiments described above and represented in the accompanying drawings of the distribution device according to the invention. Thus, the compartments 10 may have a conveyor belt instead of a bottom 36 working in conjunction with said cable 40.

The invention claimed is:

1. Distribution device for products (11) arranged in compartments (10,10'), with a transport equipment (13) for conveying these product (11) from said compartments (10, 10') to a delivery location, whereby sad transport equipment (13) comprises a deformable receiving instrument (29) which is connected to at least a first and a second fastening element (30,31), said fastening elements (30,31) being relatively movable toward and away from one another, such that the receiving instrument (29) can assume a product receiving position when said fastening elements are moved toward each other, whereby said product (11) can be moved from said compartments (10,10') to the receiving instrument (29), a product delivery position when said fastening elements are moved away from each other, whereby the products (11) are delivered from the receiving instrument (29) into said delivery counter (5);

wherein said second fastening element (31) is fixed to a movable arm (23) rotatable about a rotational shaft (24) spaced from said second fastening element (31), said movable arm (23) working conjunction wits at least one driving element (32,33) for conveying said products (11) to the receiving instrument (29), whereby, in said receiving position, this driving element (32,33) can work in conjunction with at least one of said compartment (10,10"); and characterized in that said movable arm (23) is provided on either side of the receiving instrument (29), whereby said movable arm (23) is mutually connected via said fastening element (,31), said fastening element being rod-shaped and extends between these arms (23).

2. Distribution device for products (11) arranged in compartments (10,10"), with a transport equipment (13) for conveying these products (11) from said compartments (10,10") to a delivery counter (5), whereby said transport equipment (13) comprises a deformable receiving instrument (29) which is connected to at least a first and a second fastening element (30,31), said fastening elements (30,31) being relatively movable toward and away from one another, such that the receiving instrument (29) can assume a product receiving position when said fastening elements are moved toward each other, whereby said products (11) can be moved from said compartments (10,10') to the receiving instrument (29), and a product delivery position when said fastening elements are moved away from each other, whereby the products (11) are moved from the receiving instrument (29) to said delivery counter (5);

wherein said second fastening element (31) is fixed to a movable arm (23) working in conjunction with at least one driving element (32,33) for conveying said products (11) to the receiving instrument (29), whereby, in said receiving position, this driving element (32,33) can work in conjunction with at least one of said compartments (10,10');

wherein said movable arm (23) is provided on either side of the receiving instrument (29), whereby said movable arm (23) is mutually connected via said fastening element (,31), said fastening element being rod-shaped and extends between these arms (23); and wherein each arm (23) co-operates with a separate driving element (32,33).

3. Distribution device for products (11) arranged in compartments (10,10'), with a transport equipment (13) for conveying these products (11) from said compartment (10, 10') to a delivery location, whereby said transport equipment (13) comprises a deformable receiving instrument (29) which is connected to at least a first and a second fastening element (30,31), said fastening elements (30,31) being relatively movable toward and away from one another, such that the receiving instrument (29) can assume a product receiving position when said fastening elements are moved toward each other, whereby said products (11) can be moved from said compartments (10,10') to the receiving instrument (29), a product delivery position when said fastening elements are moved away from each other, whereby the products (11) are delivered from the receiving instrument (29) into said delivery counter (5);

wherein said second fastening element (31) is fixed to a movable arm (23) rotatable about a rotational shaft (24) spaced from said second fastening element (31), said movable arm (23) working in conjunction with at least one driving element (32,33) for conveying said products (11) to the receiving instrument (29), whereby, in said receiving position, this driving element (32,33) can work in conjunction with at least one of sad compartments (10,10'); and characterized in that said driving element consists of a first gear wheel (32) co-operating with a second gear wheel (35) provided on said compartment (10,10').

4. Distribution device for product (11) arranged in compartment (10 10'), with a transport equipment (13) for conveying these products (11) from said compartments (10,10') to a delivery location, whereby said transport equipment (13) comprises a deformable receiving instrument (29) which is connected to at least a first and a second fastening element (30,31), said fastening elements (30,31) being relatively movable toward and away from one another, such that the receiving instrument (29) can assume a product receiving position when said fastening elements are moved toward each other, whereby said products (11) can be moved from said compartments (10,10') to the receiving instrument (29), a product delivery position when said fastening elements are moved away from each other, hereby the products (11) are delivered from the receiving in instrument (29) into said delivery counter (5);

wherein said second fastening element (31) is fixed to a movable arm (23) rotatable about a rotational shaft (24) spaced from said second fastening element (31), said movable arm (23) working in conjunction with at least one driving element (32,33) for conveying said products (11) to the receiving instrument (29), whereby, in said receiving position, this driving element (32,33) can work in conjunction with at least one of said compartments (10,10'); and characterized in that said compartment (10,10') has at least one pusher attachment (41) for guiding said products (11) to the receiving instrument (29), whereby this pusher attachment (41) is connected to a drive belt (40) for movement therewith, the drive belt extending over almost the entire length of said compartment (10,10') and working in conjunction with said driving element (32,33) when the receiving instrument (29) is in said receiving position.

5. Distribution device for products (11) arranged in compartments (10,10'), with a transport equipment (13) for conveying these products (11) from said compartments (10,10') to a delivery counter (5), whereby said transport equipment (13) comprises a deformable receiving instrument (29) which is connected to at least a first and a second fastening element (30,31), said fastening elements (30,31) being relatively movable toward and away from one another, such that the receiving instrument (29) can assume a product receiving position when said fastening elements are moved toward each other, whereby said products (11) can be moved from said compartments (10,10') to the receiving instrument (29), and a product delivery position when said fastening elements are moved away from each other, whereby the products (11) are moved from the receiving instrument (29) to said delivery counter (5);

wherein said second fastening element (31) is fixed to a movable arm (23) working in conjunction with at least one driving element (32,33) for conveying said products (11) to the receiving instrument (29), whereby, in said receiving position, this driving element (32,33) can work in conjunction with at least one of said compartments (10,10');

wherein said movable arm (23) is provided on either side of the receiving instrument (29), whereby said movable arm (23) is mutually connected via said fastening element (,31), said fastening element being rod-shaped and extends between these arms (23); and wherein means are provided for moving said pusher attachment (41) over a small distance in the opposite sense after certain products (11) from the corresponding compartment (10,10') have been put on the receiving instrument (29), such that this pusher attachment (41) will exert practically no pressure on the other products (11) situated in said compartment (10,10').

6. Distribution device for products (11) arranged in compartments (10,10'), with a transport equipment (13) for conveying these products (11) from said compartments (10,10') to a delivery counter (5), whereby said transport equipment (13) comprises a deformable receiving instrument (29) which is connected to at least a first and a second fastening element (30,31), said fastening elements (30,31) being relatively movable toward and away from one another, such that the receiving instrument (29) can assume a product receiving position when said fastening elements are moved toward each other, whereby said products (11) can be moved from said compartments (10,10') to the receiving instrument (29), and a product delivery position when said fastening elements are moved away from each other, whereby the products (11) are moved from the receiving instrument (29) to said delivery counter (5);

wherein said second fastening element (31) is fixed to a movable arm (23) working in conjunction with at least one driving element (32,33) for conveying said products (11) to the receiving instrument (29), whereby, in said receiving position, this driving element (32,33) can work in conjunction with at least one of said compartments (10,10');

wherein said movable arm (23) is provided on either side of the receiving instrument (29), whereby these movable arms (23) are mutually connected via said fastening element (30,31) which is rod-shaped and extends between these arms (23); and wherein said drive belt consists of a cable (40) forming a loop which is guided through two wheels (35,42), whereby the far ends of this cable are connected to one another by means of a spring element (44).

7. Distribution device for products (11) arranged in compartments (10,10'), with a transport equipment (13) for conveying these products (11) from said compartments (10,10') to a delivery counter (5), whereby said transport equipment (13) comprises a deformable receiving instrument (29) which is connected to at least a first and a second fastening element (30,31), said fastening elements (30,31) being relatively movable toward and away from one another, such that the receiving instrument (29) can assume a product receiving position when said fastening elements are moved toward each other, whereby said products (11) can be moved from said compartments (10,10') to the receiving instrument (29), and a product delivery position when said fastening elements are moved away from each other, whereby the products (11) are moved from the receiving instrument (29) to said delivery counter (5);

wherein said second fastening element (31) is fixed to a movable arm (23) working in conjunction with at least one driving element (32,33) for conveying said products (11) to the receiving instrument (29), whereby, in said receiving position, this driving element (32,33) can work in conjunction with at least one of said compartments (10,10');

wherein said movable arm (23) is provided on either side of the receiving instrument (29), whereby these movable arms (23) are mutually connected via said fastening element (30,31) which is rod-shaped and extends between these arms (23); and wherein means are provided which make it possible to interrupt the drive of said drive belt (40) when the pusher attachment (41) cannot or can hardly be moved.

8. Distribution device according to claim 6, characterized in that said spring element (44) contains a cylindrical case (45), one far end of which is connected to a first far end of said cable (40), while the second far end of the cable (40) is connected to a spring (46) extending in said case (45).

9. Distribution device for products (11) arranged in compartments (10,10'), with a mechanism (13) for conveying these products (11) from said compartments (10,10') to a delivery location, whereby said mechanism (13) comprises a receiving instrument (29) having a product receiving location and said product delivery location;

drive means carried by said receiving instrument (29) for bringing a product (11) from an elongated compartment (10) to said receiving instrument (29) when said receiving instrument (29) is in the product receiving location, said drive means comprising a driving element (32) and a driving motor (33), said drive means being adapted to reciprocate between an inoperative position and an operative position when said receiving instrument (29) is in the product receivinglocation;

a product drive belt (40) extending substantially the length of the compartment (10), said drive belt carrying a pusher attachment (41) which extends transversely across at least part of the width of the compartment (10), said drive belt being supported by a wheel (35) adjacent a front end of said compartment (10), said wheel (35) being engageable with said driving element (32);

whereby, in its operative position, said driving element (32) engages said gear wheel (35) and, upon operation of said motor (33) causes rotation of said wheel (35) to in turn cause movement of the drive belt and consequent movement in a forward direction of the pusher attachment (41) toward the front of the elongated compartment (10), whereby a product (11) is pushed off the front of the compartment (10) and onto the receiving instrument (29) in the product receiving location thereof.

10. The distribution device of claim 9 wherein said driving element is a gear wheel and said product drive belt is a cable.

11. The distribution device of claim 9 wherein said driving element (32) is mounted on a sliding rod (34) which is guided along a guide strut (20), whereby, when said receiving instrument (29) moves to the product receiving position, said sliding rod (34) is moved along said guide strut (20) to move said driving element (32) into engagement with said gear wheel (35).

12. Distribution device for products (11) arranged in compartments (10,10'), with a mechanism (13) for conveying these products (11) from said compartments (10,10') to a delivery location, whereby said mechanism (13) comprises a receiving instrument (29) having a product receiving location, whereby said products (11) can be moved from said compartments (10,10') to the receiving instrument (29), the receiving instrument (29) having a product delivery location, whereby the products (11) are delivered from the receiving instrument (29) to the delivery location which is spaced laterally from at least some of said compartments, drive means carried by said receiving instrument (29) for bringing a product (11) from an elongated compartment (10) to said receiving instrument (29) when said receiving instrument (29) is in the product receiving location, said drive means comprising a diving element (32), and a driving motor (33), said drive means being adapted to reciprocate between an inoperative position and an operative position when said receiving instrument (29) is in the product receiving location, a product drive belt (40) extending substantially the length of the compartment (10), said drive belt carrying a pusher attachment (41) which extends transversely across at least part of the width of the compartment (10), said drive belt being supported by a wheel (35) adjacent a front end of said compartment (10), said wheel (35) being engageable with said driving element (32) when the receiving instrument (29) is in the product receiving location, whereby, in its operative position, said driving element (32) engages said gear wheel (35) and, upon operation of said motor (33) causes rotation of said wheel (35) to in turn cause movement of the drive belt and consequent movement in a forward direction of the pusher attachment (41) toward the front of the elongated compartment (10), whereby a product (11) is pushed off the front of the compartment (10) and onto the receiving instrument (29) in the product receiving location thereof.

* * * * *